US005368268A

United States Patent [19]

Jodwischat

[11] Patent Number: 5,368,268

[45] Date of Patent: Nov. 29, 1994

[54] SOAP HOLDING DEVICE

[75] Inventor: Gerhard D. Jodwischat, Simi Valley, Calif.

[73] Assignee: Coger Industries, Inc., Palmdale, Calif.

[21] Appl. No.: 975,714

[22] Filed: Nov. 13, 1992

[51] Int. Cl.[5] ..... A47G 1/17

[52] U.S. Cl. ..... 248/309.4; 248/683; 248/684

[58] Field of Search ..... 248/309.4.682, 683, 248/684

[56] References Cited

U.S. PATENT DOCUMENTS 3,472,391 10/1969 Bolognesi ..... 248/309.4 X 3,552,705 1/1971 Caster ..... 248/683 X

FOREIGN PATENT DOCUMENTS 1031084 6/1953 France ..... 248/309.4
1112926 3/1956 France ..... 248/309.4
1369882 7/1964 France ..... 248/309.4
1515966 1/1968 France ..... 248/683
0951137 3/1964 United Kingdom ..... 248/309.4
1121438 7/1968 United Kingdom ..... 248/683

*Primary Examiner*—Ramon O. Ramirez
*Attorney, Agent, or Firm*—William L. Klima

[57] ABSTRACT

An soap holding device for suspending a bar of soap in a bathroom or shower. The soap holding device includes a body portion and mounting portion to facilitate installation.

9 Claims, 4 Drawing Sheets

SOAP HOLDING DEVICE

BACKGROUND OF THE INVENTION

1. Field of the Invention

The present invention relates to a device for holding soap by magnetic attraction.

2. Prior Art

There exits a number of U.S. patents directed to magnetic devices for holding soap that include a magnet for attracting a piece of metal secured to a bar of soap. Most of these devices are one piece in construction, excluding the piece that attaches to the bar of soap. These devices mount directly to bathroom walls, tiles, tubs or other typical support surfaces found in a bathroom.

SUMMARY OF THE INVENTION

An object of the present invention is to provide an improved soap holder.

The soap holder according to the present invention can be mounted to a wall or other supporting surface in a conventional bathroom such a bath tub, tile or fiberglass surround, drywall, etc. The soap holder according to the present invention is constructed so as to be cantilever mounted from the support surface.

The simplest constructions of a soap holder according to the present invention are one piece and directly connected to a support surface such as by fastener and/or adhesive. The soap holder is provided with means for connecting the soap holder to the wall. For example, in one embodiment at least on hole is provided for attachment of the soap holder to the support surface with a threaded fastener such as a screw. The hole can be countersunk to provide a flush surface of the head of the screw with the surface of the soap holder. Alternatively, the hole can be shaped as a keyhole to allow the soap holder to be slip over the head of the screw followed by final tighten of the screw to facilitate installation. As another alternative, the soap holder can be provided with a slot that fits over the head of the screw, again to facilitate installation.

In a preferred embodiment, the soap holder comprises a body portion and a mounting portion, which mounting portion can be attached to a support surface in the bathroom followed by the body portion being connected to the mounting portion to facilitate installation. More preferably, the soap holder is releasably connected to the mount to allow easy replacement and/or cleaning. In the preferred embodiment, it is important that the body of the soap holder is securely connected to the mount to provide a durable and long lasting product that can survive months or years of continuous use.

The body of the soap holder can be secured to the mount in many different manners. The details of these various connection will be described hereinbelow.

DETAILED DESCRIPTION OF PREFERRED EMBODIMENTS

Figure 1:
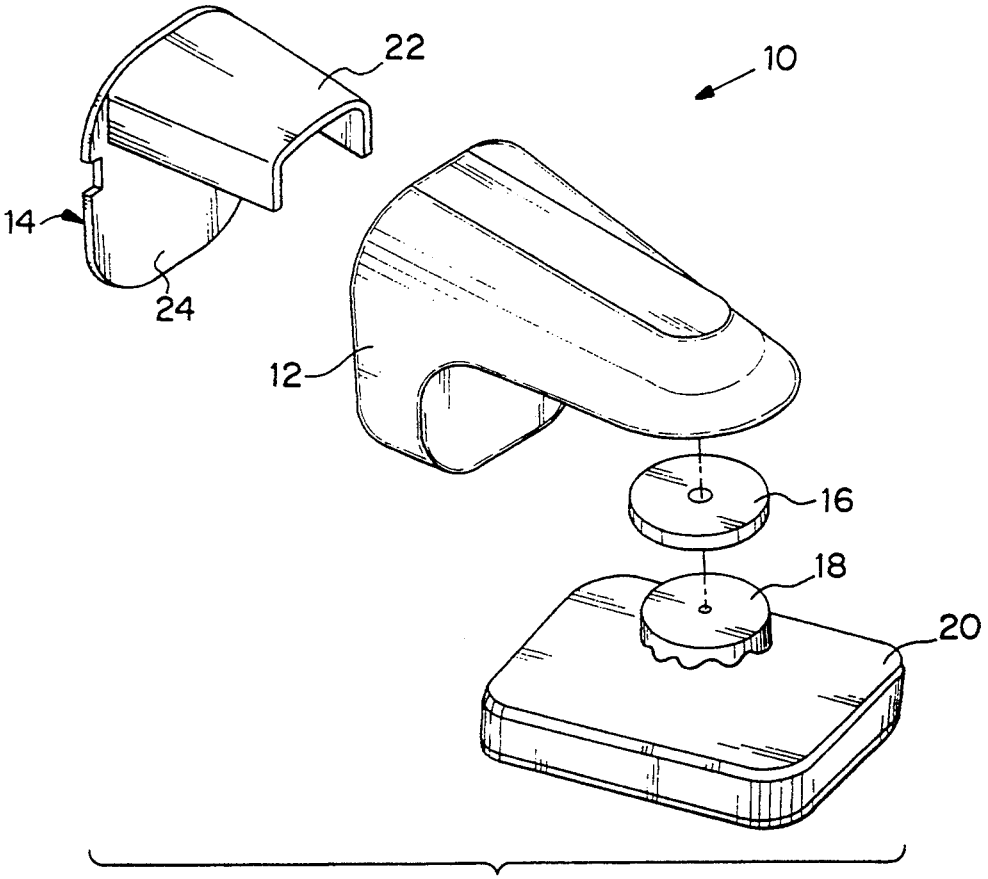
FIG. 1 is a broken apart perspective view of an embodiment of the soap holding device according to the present invention comprising a body portion and a mounting portion.

A preferred embodiment of a soap holding device 10 according to the present invention is shown in FIG. 1. The soap holding device 10 comprises a body portion 12 and a mounting portion 14.

The body portion 12 is provided with a magnet 16 for magnetically attracting a metal cap 18 that is pressed into a bar of soap 20 to be suspended by the device 10.

Figure 2:
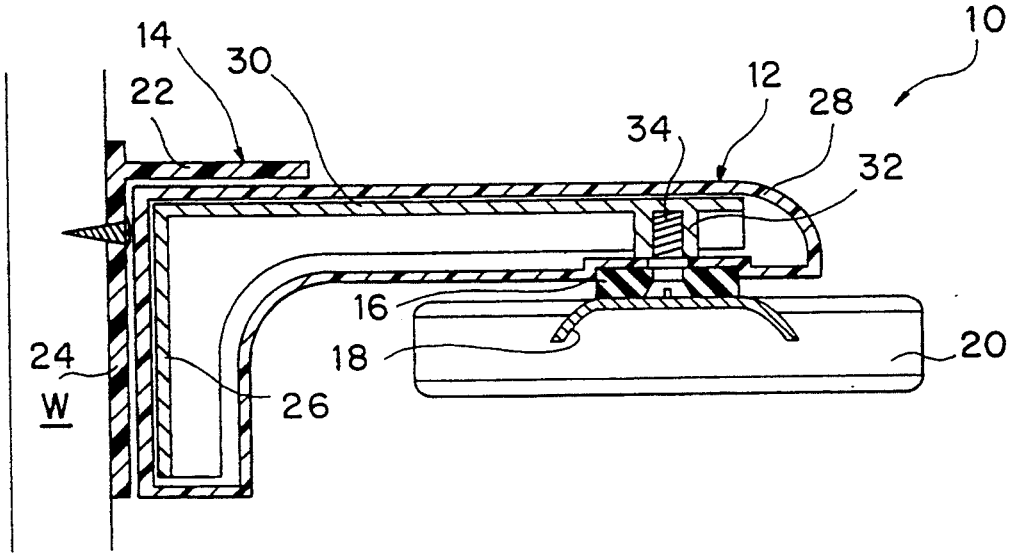
FIG. 2 is a cross-sectional view of the soap holding device shown in FIG. 1 mounted on a wall.

In the embodiment shown in FIG. 2, the body portion 12 and the mounting portion 14 are both L-shaped. The L-shape configuration of the components provide a strong cantilever arrangement to accommodate the forces exerted on the device when a bar of soap magnetically coupled to the device is forcibly removed. Further, this structural arrangement can endure substantial inadvertent forces such as a child gripping the end of the device to lift himself or herself up or withstand being hit during cleaning the device or surrounding support.

Further, the mounting portion 14 includes a sleeve portion 22 cantilever mounted to a plate portion 24. The sleeve portion 22 accommodates a top base portion of the body portion 12. The sleeve portion 22 can include a guide such as one or more ribs or slots (not shown) on the inner surface thereof cooperating with respective slots or ribs on the top base portion of the body portion 12 to provide a connection therebetween. Other connections will be described in detail below.

The base 26 of the body portion 12 is desirably flat and is placed in contact with the plate portion 24 of the mounting portion 14 when installed, as shown in FIG. 2. This arrangement further increases the strength and stability of the connection between the body portion 12 and mounting portion 14.

The details of the internal structure of the body portion 12 are shown in FIG. 2. An external shell 28 made of plastic (alternatively made of metal or ceramic) surrounds a metal frame 30 (alternatively made of plastic). For example, the metal frame 30 can be made from stamped aluminum sheet. Alternatively, the body portion 12 can be made entirely of ceramic.

The external shell 28 can be separately made, for example by injection molding, and subsequently connected to the metal frame 30 such as by bonding with adhesive. Alternatively, the external shell 28 can be formed directly onto the metal frame 30 by molding.

The metal frame 30 includes an extension 32 for accommodating a self-tapping screw 34, which secures the magnet 16 to the body portion 12 of the device 10. Alternatively, the body portion 12 can be made of solid plastic material, and the self-tapping screw 34 can be set or screwed into the plastic material.

The magnet 16 can be attached to the body portion 12 by a fastener such as self-tapping screw 34 and/or can be adhered with adhesive.

The body portion 12 connects to the mounting portion 14 to form a permanent or releasable connection depending on the application. For example, a permanent connection may be desirable for use in a public rest room or shower to prevent tampering of the device once installed. In contrast, it may be desirable to have a releasable connection for household use to allow cleaning, maintenance, or replacement of the device.

Figure 3:
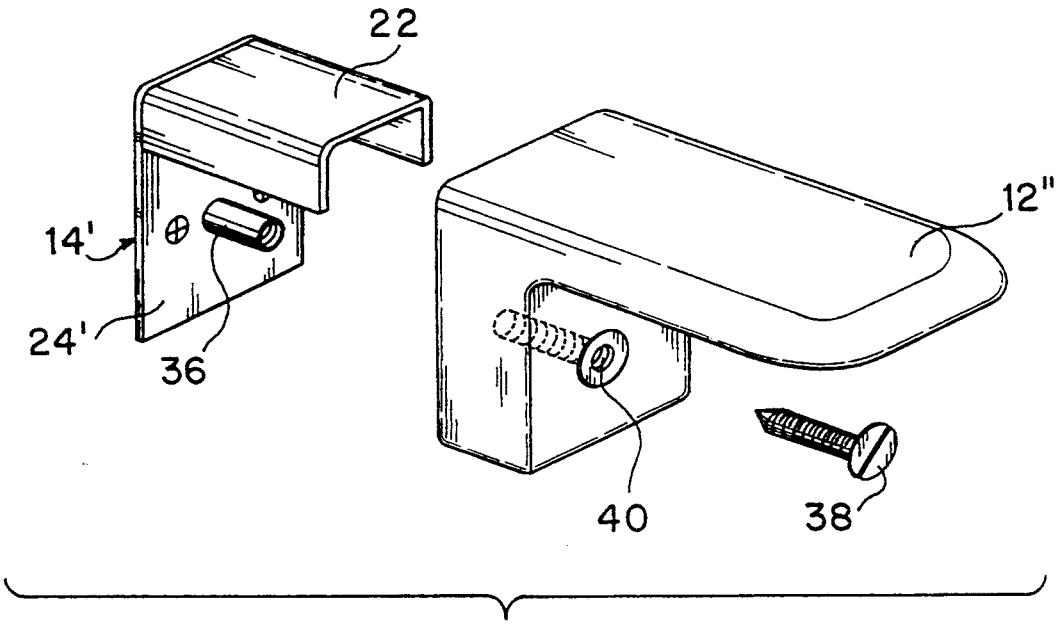
FIG. 3 is a broken apart perspective view of a soap holding device according to the present invention illustrating one type of connection between the body portion and mounting portion.
Figure 4:
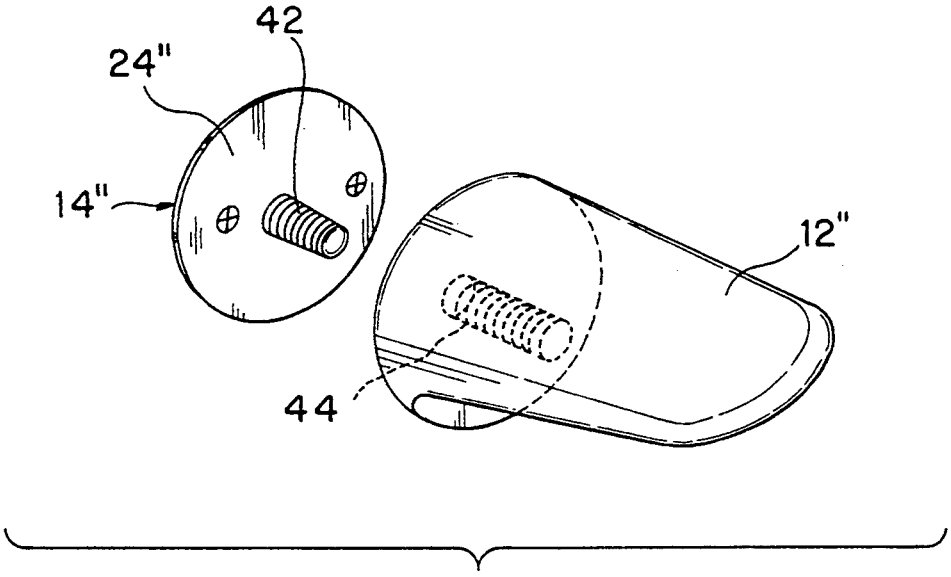
FIG. 4 is a broken apart perspective view of a soap holding device according to the present invention illustrating another type of connection between the body portion and mounting portion.
Figure 5:
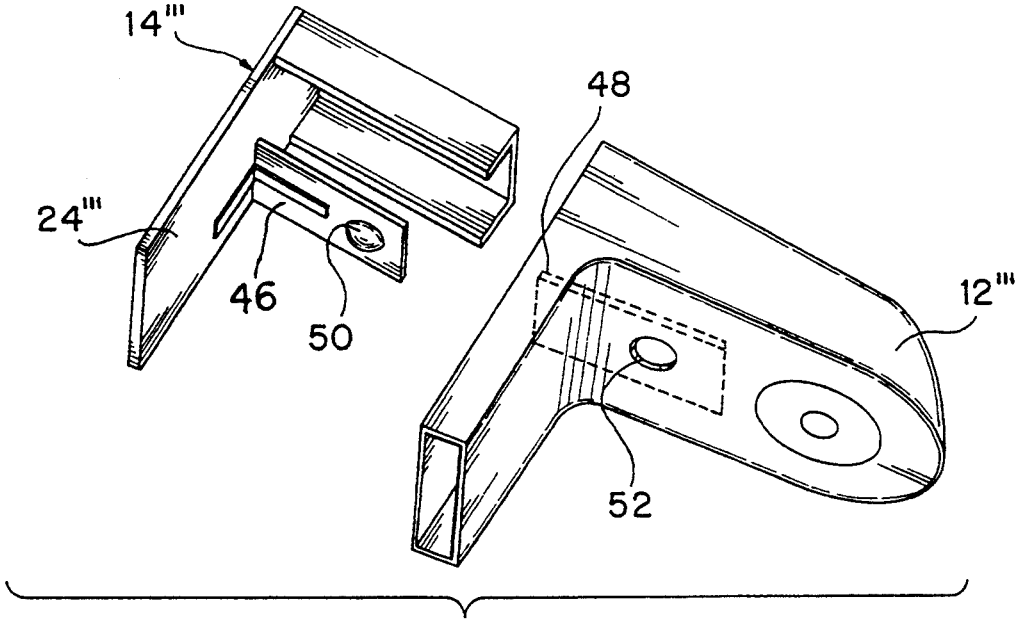
FIG. 5 is a broken apart perspective view of a soap holding device according to the present invention illustrating a further type of connection between the body portion and mounting portion.

A variety of connections can be used for connecting the body portion 12 to the mounting portion 14, as shown in FIGS. 3–5.

In the embodiment shown in FIG. 3, the connection is defined by an extension 36 on the plate portion 24 cooperating with a self-tapping screw 38. The mounting portion 14 is first attached to a wall by a pair of screws. Then the body portion 12' is fitted into the mounting portion 14, and the self-trapping screw 38 is placed through hole 40 in the body portion 12' and screwed into the extension 36 to draw the body portion 12' against the mounting portion 14.

In the embodiment shown in FIG. 4, the connection is defined by a threaded bolt 42 extending from the plate portion 24'' of the mounting portion 14'', and cooperating with a threaded hole 46 in the base of the body portion 12''. The mounting portion 14'' is attached to a wall by a pair of screws. Then the threaded hole 44 of the body portion 12'' is aligned with the threaded bolt 42, and then the body portion 12'' is rotated.

In the embodiment shown in FIG. 5, the connection is defined by a bracket 46 extending from the plate portion 24''' of the mounting portion 14''', which bracket 46 is received within a slot 48 in the body portion 12'''. The bracket 46 is provided with a protrusion 50, which cooperates with a hole 52 in the body portion 12''' leading to the slot 48. The mounting portion 14''' is attached to a wall by a pair of screws. Then the end of the bracket 46 is fitted into the entrance to the slot 48, and the body portion 12''' is pressed on until the protrusion 50 of the bracket meets with the hole 52, releasably locking the body portion 12''' to the mounting portion 14'''. The body portion 12''' can be removed from the mounting portion 14''' by simply pressing upwardly the protrusion 50 out of the hole 52 and pulling the body portion 12''' away from the wall.

Figure 6:
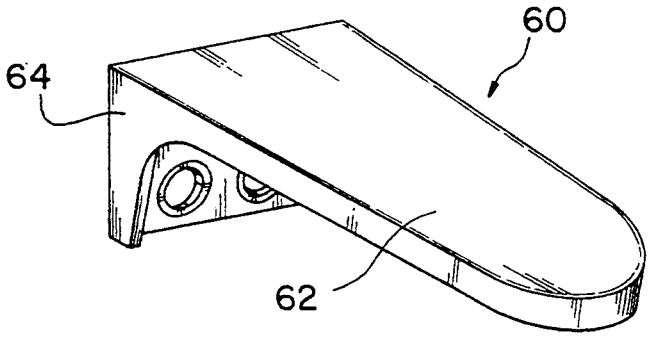
FIG. 6 is another embodiment of a soap holding device according to the present invention having a one piece construction.
Figure 7:
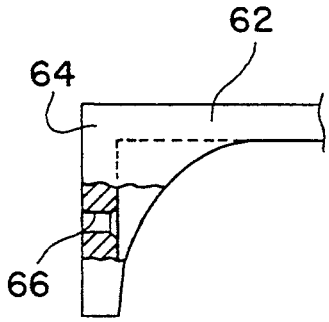
FIG. 7 is a side elevational view of the soap holding device shown in FIG. 3.
Figure 8:
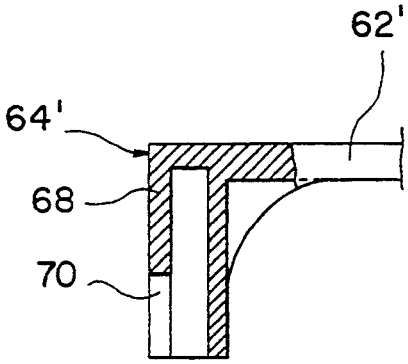
FIG. 8 is a side elevational view of another one piece embodiment of a soap holding device according to the present invention.

Another embodiment of the soaping holding device 60 according to the present invention is shown in FIGS. 6–8. This is a one piece construction wherein the body portion 62 is a one piece unit with the mounting portion 64. The device 60 can be made of plastic or metal.

The device 60 is L-shaped to provide a strong cantilever mounting to a structure such as a wall. In the embodiment shown in FIG. 7, the mounting portion 64 is provided with a set of countersunk holes 66 for accommodating mounting fasteners. In a different embodiment shown in FIG. 8, the mounting portion 64' is provided with a mounting plate 68 having a set of slots 70 for fitting over the heads of screws already anchored in the wall.

Various arrangements for mounting the soap holding device according to the present invention is shown in FIGS. 9A–9E. These arrangements can be applied to two piece or one piece embodiments.

Figure 9A:
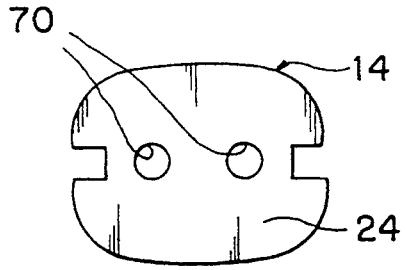
FIGS. 9A–9E illustrate various means for connecting the mounting portion to a wall or other support structure in a room.
Figure 9B:
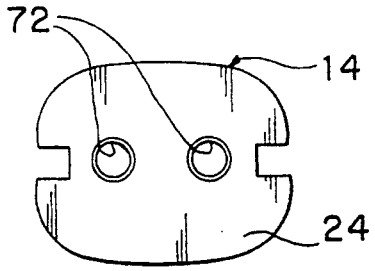
Figure 9C:
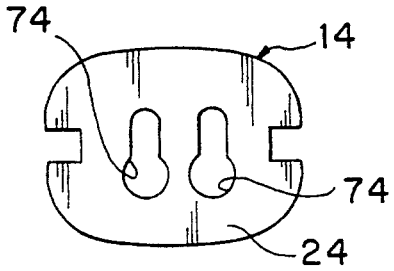
Figure 9D:
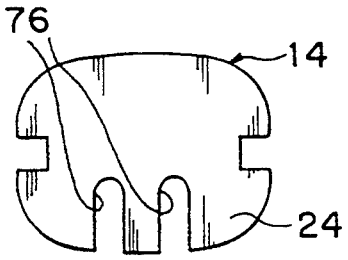
Figure 9E:
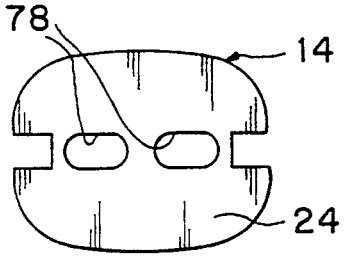

In FIG. 9A, the plate portion 24 is provided with a set of holes 70 to accommodate a set of screws. In FIG. 9B, the plate portion 24 is provided with a set of countersunk holes 72 to accommodate a set of screws. In FIG. 9C, the plate portion 24 is provided with a set of keyholes 74 to accommodate a set of screws. In FIG. 9D, the plate portion 24 is provided with a set of open-ended slots 76 to accommodate a set of screws. In FIG. 9E, the plate portion 24 is provided with a set of closed-ended slots 78 to accommodate a set of screws.

Alternatively, the mounting portion 14 can be provided with double-sided adhesive tap for affixing to a bathroom surface.

I claim:

1. A soap holding device, comprising:

a body portion, said body portion is cantilever supported from said mounting portion, said body portion is provided with a connection portion positioned substantially perpendicular relative to a lengthwise direction of said body portion, said body portion is provided with a slot and a hole, said hole extending from an outside surface of said body portion to said slot;

a magnet connected to said body portion, said magnet is positioned underneath an end of said body portion;

a mounting portion connected to said body portion in the assembled device, said mounting portion is provided with a bracket having a protrusion that extends into said hole for locking said body portion to said mounting portion when said bracket is fully received within said slot; and a fastener arrangement for securing said mounting portion to a support.

2. A soap holding device according to claim 1, wherein said body portion is accommodated with a portion of said mounting portion.

3. A soap holding device according to claim 1, wherein said body portion is releasably connected to said mounting portion.

4. A soap holding device according to claim 2, wherein said body portion is releasably connected to said mounting portion.

5. A soap holding device according to claim 1, wherein said body portion is L-shaped.

6. A soap holding device according to claim 1, wherein said hole is positioned on an underneath portion of said body portion to hide it from view.

7. A soap holding device, comprising:

a body portion having an elongated portion extending from a perpendicular base portion, said body portion is cantilever supported from said mounting portion, said body portion is provided with a connection portion positioned substantially perpendicular relative to a lengthwise direction of said body portion, said body portion is provided with a slot and hole extending from an outside of said body portion to said slot;

a magnet connected to said body portion, said magnet is positioned underneath an end of said body portion;

a mounting portion including means for connecting to a support structure, said mounting portion having a mounting surface, said body portion is connected to said mounting portion when installed with said base portion of said body portion placed in contact with said mounting surface of said mounting portion, said mounting portion is provided with a bracket having a protrusion that extends into said hole for locking said body portion to said mounting portion when said bracket is fully received within said slot; and a device associated with a piece of soap that is attracted to said magnet.

8. A soap holding device, comprising:

a body portion, said body portion is cantilever supported from said mounting portion, said body portion is provided with a connection portion positioned substantially perpendicular relative to a lengthwise direction of said body portion;

a magnet connected to said body portion, said magnet is positioned underneath an end of said body portion;

a mounting portion connected to said connection portion of said body portion in the assembled device, said mounting portion including a cantilever mounted sleeve for receiving a base of said body portion for stabilizing the connection between said body portion and said mounting portion; and a fastener arrangement for securing said mounting portion to a support structure.

9. A soap holding device according to claim 8, wherein said body portion is L-shaped and said mounting portion is correspondingly L-shaped to accommodate said L-shaped body portion.

* * * * *